US005759754A

United States Patent [19]

Dickerson

[11] Patent Number: 5,759,754

[45] Date of Patent: Jun. 2, 1998

[54] MEDICAL DIAGNOSTIC FILM FOR SOFT TISSUE IMAGING

[75] Inventor: Robert Edward Dickerson, Hamlin, N.Y.

[73] Assignee: Eastman Kodak Company, Rochester, N.Y.

[21] Appl. No.: 690,138

[22] Filed: Jul. 31, 1996

[51] Int. Cl.[6] ..... G03C 1/46; G03C 1/805

[52] U.S. Cl. ..... 430/502; 430/139; 430/507; 430/517; 430/567; 430/966

[58] Field of Search ..... 430/502, 567, 430/966, 517, 139, 507

[56] References Cited

U.S. PATENT DOCUMENTS

| | | | |
|---|---|---|---|
| 3,545,971 | 12/1970 | Barnes et al. | 96/61 |
| 4,414,304 | 11/1983 | Dickerson | 430/353 |
| 4,425,425 | 1/1984 | Abbott et al. | 430/502 |
| 4,425,426 | 1/1984 | Abbott et al. | 430/502 |
| 4,710,637 | 12/1987 | Luckey et al. | 250/486.1 |
| 4,803,150 | 2/1989 | Dickerson et al. | 430/502 |
| 4,900,652 | 2/1990 | Dickerson et al. | 430/502 |

*Primary Examiner*—Thorl Chea
*Attorney, Agent, or Firm*—Carl O. Thomas

[57] ABSTRACT

A radiation-sensitive medical diagnostic film for soft tissue imaging, particularly mammography, is disclosed. The film allows more rapid processing than films currently available for mammographic imaging and maintains acceptably high levels of image sharpness and low levels of mottle. The radiographic film records medical diagnostic images of soft tissue through (a) exposure by a single intensifying screen located to receive an image bearing source of X-radiation and (b) processing, including development, fixing and drying, in 90 seconds or less comprised of a film support transparent to radiation emitted by the intensifying screen and having opposed front and back major faces and an image-forming portion for providing, when imagewise exposed by the intensifying screen and processed, an average contrast in the range of from 2.5 to 3.5, measured over a density above fog of from 0.25 to 2.5.

10 Claims, No Drawings

MEDICAL DIAGNOSTIC FILM FOR SOFT TISSUE IMAGING

FIELD OF THE INVENTION

The invention relates to films containing radiation-sensitive silver halide emulsions for creating medical diagnostic images of soft tissue when imagewise exposed with an intensifying screen.

DEFINITIONS

James *The Theory of the Photographic Process*, 4th Ed., Macmillan, N.Y., 1977, is hereinafter referred to as "James".

References to silver halide grains or emulsions containing two or more halides name the halides in order of ascending concentrations (see James p. 4).

The term "high bromide" refers to silver halide grains and emulsions that contain greater than 50 mole percent bromide, based on total silver.

The terms "front" and "back" are herein employed to indicate the sides of a film nearest and farthest, respectively, from the source of image bearing radiation.

The term "dual-coated" refers to a film that has silver halide emulsion layers coated on opposite sides of its support.

The term "half peak absorption bandwidth" of a dye is the spectral range in nm over which it exhibits a level of absorption equal to at least half of its peak absorption ($\lambda_{max}$).

The term "rapid access processor" is employed to indicate a radiographic film processor that is capable of providing dry-to-dry processing in 90 seconds or less. The term "dry-to-dry" is used to indicate the processing cycle that occurs between the time a dry, imagewise exposed element enters a processor to the time it emerges, developed, fixed and dry.

The acronym MTF is employed in referring to modulation transfer factors and modulation transfer functions. Modulation transfer factor measurement for intensifying screen-radiographic film systems is described by Kuniio Dio et al, "MTF and Wiener Spectra of Radiographic Screen-Film Systems", U.S. Department of Health and Human Services, pamphlet FDA 82-8187. The profile of individual modulation transfer factors over a range of cycles per mm constitutes a modulation transfer function. MTF measurements provide an art recognized quantification of radiographic image sharpness.

The term "mottle" refers to image noise. According to accepted usage in the art, the term "structure mottle" is used to indicate the image noise attributable to the structure of the radiographic element (and intensifying screen or screens, if employed) while the term "quantum mottle" is used to indicate the image noise attributable to the source of X-radiation employed.

*Research Disclosure* is published by Kenneth Mason Publications, Ltd., Dudley House, 12 North St., Emsworth, Hampshire P010 7DQ, England.

BACKGROUND

The use of radiation-sensitive silver halide emulsions for medical diagnostic imaging can be traced to Roentgen's discovery of X-radiation by the inadvertent exposure of a silver halide photographic element. In 1913 the Eastman Kodak Company introduced its first product specifically intended to be exposed to X-radiation.

The desirability of limiting patient exposure to high levels of X-radiation has been recognized from the inception of medical radiography. In 1918 the Eastman Kodak Company introduced the first medical radiographic product which was dual-coated—that is, coated with silver halide emulsion layers on the front and back of the support.

At the same time it was recognized that silver halide emulsions are more responsive to light than to X-radiation. The Patterson Screen Company in 1918 introduced matched intensifying screens for Kodak's first dual-coated (Duplitized™) radiographic element. An intensifying screen contains a phosphor that absorbs X-radiation and emits radiation of a longer wavelength, usually in the near ultraviolet, blue, or green portion of the spectrum.

While the necessity of limiting patient exposure to high levels of X-radiation was quickly appreciated, the question of patient exposure to even low levels of X-radiation emerged gradually. The separate development of soft tissue radiography, which requires much lower levels of X-radiation, can be illustrated by mammography. The first intensifying screen-radiographic film combination for mammography was introduced in the early 1970's. Mammographic film contains a single silver halide emulsion layer and is exposed by a single intensifying screen, usually interposed between the film and the source of X-radiation. Mammography employs low energy X-radiation—that is, radiation which is predominantly of an energy level less than 40 keV.

In mammography, as in many forms of soft tissue radiography, pathological features sought to be identified are often quite small and not much different in density than surrounding healthy tissue. Thus, relatively high average contrast, in the range of from 2.5 to 3.5, over a density range of from 0.25 to 2.0 is typical. Limiting X-radiation energy levels increases the absorption of the X-radiation by the intensifying screen and minimizes X-radiation exposure of the film, which can contribute to loss of image sharpness and contrast.

As radiologists began to generate large volumes of medical diagnostic images, the need arose for more rapid processing. The emergence of rapid access processing is illustrated by Barnes et al U.S. Pat. No. 3,545,971. Successful rapid access processing requires limiting the drying load—that is, the water ingested by the hydrophilic colloid layers, including the silver halide emulsion layers, that must be evaporated to produce a dry image bearing element. One possible approach is to foreharden the film fully, thereby reducing swelling (water ingestion) during processing. Because silver image covering power (maximum density divided by the silver coating coverage) of silver halide medical diagnostic films was markedly reduced by forehardening of the films, it was for many years the accepted practice not to foreharden the films fully, but to complete hardening of diagnostic films during rapid access processing by incorporating a pre-hardener, typically glutaraldehyde, in the developer. Dickerson U.S. Pat. No. 4,414,304 (hereinafter referred to as Dickerson I) demonstrates full forehardening with low losses in covering power to be achievable with thin tabular grain emulsions.

Since adopting full forehardening of tabular grain silver halide emulsion containing radiographic elements further efforts to reduce the drying load placed on the rapid access processors has largely focused on limiting the hydrophilic colloid content of the medical diagnostic elements. However, when the hydrophilic colloid content of the emulsion layer falls too low, the problem of wet pressure sensitivity is encountered. Wet pressure sensitivity is the appearance of graininess produced by applying pressure to the wet emulsion during development. In rapid access processing the film passes over guide rolls, which are capable of applying sufficient pressure to the wet emulsion during development to reveal any wet pressure sensitivity, particularly if any of the guide rolls are in less than optimum adjustment.

Since mammographic films locate all of the silver halide emulsion on one side of the support, the resulting layer unit contains higher silver halide and hydrophilic colloid coating coverages and hence larger amounts of water ingested during development and fixing that must be removed during drying than the layer units of a dual-coated film, which approximately halves the silver halide and hydrophilic colloid per side by dividing the silver halide and hydrophilic colloid equally between front and back layer units. Thus, conventional dual-coated films are capable of more acceleration of rapid access processing than mammographic films.

There are several problems that have kept mammographic films from successfully adopting dual-coated formats and thereby improving their rapid access processing capability. Dual-coated films have been conventionally exposed with a front and back pair of intensifying screens. The front screen is provided to expose the layer unit on the front side of the film support and the back screen is provided to expose the layer unit on the back side of the support. Unfortunately some of the light emitted by the front screen also exposes the back layer unit and some of the light emitted by the back screen exposes the front layer unit. This results in a reduction in sharpness and is referred to as crossover.

Abbott et al U.S. Pat. Nos. 4,425,425 and 4,425,426 (hereinafter collectively referred to as Abbott et al) demonstrate that spectrally sensitized tabular grain emulsions are capable of reducing crossover to less than 20 percent—that is, less than 20 percent of the light emitted by the front screen is transmitted to the back layer unit.

Subsequently, Dickerson et al U.S. Pat. Nos. 4,803,150 and 4,900,652 (hereinafter referred to as Dickerson et al I and II) demonstrated an arrangement for essentially eliminating crossover by employing spectrally sensitized tabular grain emulsions in combination with front and back coatings that contain a particulate processing solution decolorizable dye interposed between the front and back emulsion layers and the support. Unfortunately, this requires two additional hydrophilic colloid layers to accommodate the added processing solution decolorizable dye. Nevertheless, Dickerson et al II demonstrates management of hydrophilic colloid in this format to realize the advantage of accelerated rapid access processing.

Luckey et al U.S. Pat. No. 4,710,637 represents an unsuccessful attempt to undertake mammographic imaging using dual-coated film. To allow a front and back pair of intensifying screens to be employed in combination with a dual-coated film, Luckey et al found it necessary to thin the front screen to limit its absorption of low energy X-radiation. Although the teachings of Luckey et al and Abbott et al and eventually those of Dickerson et al I and II were all employed, the commercial sale of dual-coated mammographic film was discontinued for lack of acceptance by radiologists. The radiologists found pathology diagnoses to be unduly complicated by structure that could not be eliminated. Use of a front and back intensifying screen pair to expose the dual-coated film increased the sharpness (MTF) and X-radiation transmission requirements for the front screen as compared to a single screen, single emulsion layer unit imaging system, leading to unattainable uniformity requirements for the front screen phosphor layer. In other words, the dual-coated films failed to produce mammographic images acceptable to radiologists, since they placed performance requirements on the front screens of the intensifying screen pairs used for their exposure that could not be satisfied.

Typically dual-coated silver halide medical diagnostic films are processed in a rapid access processor in 90 seconds or less. For example, the Kodak X-OMAT M6A-N™ rapid access processor employs the following processing cycle:

| | |
|---|---|
| Development | 24 seconds at 35° C. |
| Fixing | 20 seconds at 35° C. |
| Washing | 20 seconds at 35° C. |
| Drying | 20 seconds at 65° C. |

with up to 6 seconds being taken up in film transport between processing steps.

A typical developer (hereinafter referred to as Developer A) exhibits the following composition:

| | |
|---|---|
| Hydroquinone | 30 g |
| Phenidone ™ | 1.5 g |
| KOH | 21 g |
| $NaHCO_3$ | 7.5 g |
| $K_2SO_3$ | 44.2 g |
| $Na_2S_2O_3$ | 12.6 g |
| NaBr | 35.0 g |
| 5-Methylbenzotriazole | 0.06 g |
| Glutaraldehyde | 4.9 g |
| Water to 1 liter/pH 10.0 | |

A typical fixer exhibits the following composition:

| | |
|---|---|
| Sodium thiosulfate, 60% | 260.0 g |
| Sodium bisulfite | 180.0 g |
| Boric acid | 25.0 g |
| Acetic acid | 10.0 g |
| Water to 1 liter/pH 3.9—4.5 | |

RELATED APPLICATION

Dickerson et al U.S. Ser. No. 08/688,980, concurrently filed and commonly assigned, titled FILMS FOR REPRODUCING MEDICAL DIAGNOSTIC IMAGES AND PROCESSES FOR THEIR USE, discloses a film for reproducing digitally stored medical diagnostic images through exposure and processing, including development, fixing and drying, in 90 seconds. The film is comprised of a support that is transparent to exposing radiation, a processing solution permeable front layer unit coated on the front major face of the support capable of absorbing up to 60 percent of the exposing radiation and containing less than 30 mg/dm$^2$ of hydrophilic colloid and less than 30 mg/dm$^2$ silver in the form of radiation-sensitive silver halide grains, and a processing solution permeable back layer unit coated on the back major face of the support containing less than 40 mg/dm$^2$ of hydrophilic colloid, silver in the form of radiation-sensitive silver halide grains accounting for from 40 to 60 percent of the total radiation-sensitive silver halide present in the film, and a dye capable of providing an optical density of at least 0.40 in the wavelength region of the exposing radiation intended to be recorded and an optical density of less than 0.1 in the visible spectrum at the conclusion of film processing.

PROBLEM TO BE SOLVED

Radiation-sensitive silver halide containing radiographic film for recording medical diagnostic images of soft tissue (e.g., mammographic film) through exposure by a single intensifying screen located to receive X-radiation and emit light to the film have required all of the latent image-forming silver halide grains to be coated on one side of the support to achieve optimum levels of image sharpness. This in turn requires a higher coating coverage of hydrophilic colloid than is employed on either side of dual-coated radiographic films. The higher hydrophilic colloid coverages limit the extent to which rapid access processing can be accelerated. Thus, currently mammographic and similar soft tissue imaging medical diagnostic films are coated in a single-sided format to maximize image sharpness and uniformity, but cannot achieve the higher rates of rapid access processing finding increasing use in processing dual-coated radiographic films.

An attempt by Luckey et al, cited above, to provide mammographic film in dual-coated format was ultimately rejected by radiologists for failing to provide images of acceptably high sharpness and low mottle.

No medical diagnostic radiographic film for imaging soft tissue, such as mammographic film, has heretofore been available combining high levels of image sharpness and uniformity and the capability of accelerated rates of rapid access processing attainable with dual-coated radiographic films.

SUMMARY OF THE INVENTION

The present invention has as its purpose to provide a radiation-sensitive medical diagnostic film for soft tissue imaging, particularly a mammographic film, that allows more rapid processing than films currently available for these imaging applications and that maintains acceptably high levels of image sharpness and low levels of mottle.

In one aspect this invention is directed to a radiographic film for recording medical diagnostic images of soft tissue through (a) exposure by a single intensifying screen located to receive an image bearing source of X-radiation and (b) processing, including development, fixing and drying, in 90 seconds or less comprised of a film support transparent to radiation emitted by the intensifying screen and having opposed front and back major faces and an image-forming portion for providing, when imagewise exposed by the intensifying screen and processed, an average contrast in the range of from 2.5 to 3.5, measured over a density above fog of from 0.25 to 2.5, wherein the image-forming portion is comprised of (i) a processing solution permeable front layer unit coated on the front major face of the support capable of absorbing up to 60 percent of the exposing radiation and containing less than 30 mg/dm$^2$ of hydrophilic colloid and less than 30 mg/dm$^2$ silver in the form of radiation-sensitive silver halide grains, and (ii) a processing solution permeable back layer unit coated on the back major face of the support containing less than 40 mg/dm$^2$ of hydrophilic colloid, silver in the form of radiation-sensitive silver halide grains accounting for from 40 to 60 percent of the total radiation-sensitive silver halide present in the film, and a dye capable of providing an optical density of at least 0.40 in the wavelength region of the exposing radiation intended to be recorded and an optical density of less than 0.1 in the visible spectrum at the conclusion of film processing.

DESCRIPTION OF PREFERRED EMBODIMENTS

A film satisfying the requirements of the invention contains the following elements:

| |
|---|
| Front Layer Unit (FLU) |
| Transparent Film Support (S) |
| Back Layer Unit (BLU) |
| (I) |

The transparent film support S is transparent to radiation emitted by an intensifying screen for imagewise exposure of the film. Additionally the film support is transparent, at least following processing, in the visible region of the spectrum to permit simultaneous viewing of images in the front and back layer units after imagewise exposure and processing.

Although it is possible for the transparent film support to consist of a flexible transparent film, the usual construction is as follows:

| |
|---|
| Surface Modifying Layer Unit (SMLU) |
| Transparent Film (TF) |
| Surface Modifying Layer Unit (SMLU) |
| (S-I) |

Since the transparent film TF is typically hydrophobic, it is conventional practice to provide surface modifying layer units SMLU to promote adhesion of the hydrophilic front and back layer units. Each surface modifying layer unit typically consists of a subbing layer overcoated with a thin, hardened hydrophilic colloid layer. Any conventional dual-coated medical diagnostic film support can be employed. Medical diagnostic film supports usually exhibit these specific features: (1) the film support is constructed of polyesters to maximize dimensional integrity rather than employing cellulose acetate supports as are most commonly employed in photographic elements and (2) the film supports are blue tinted to contribute the cold (blue-black) image tone sought in the fully processed films, whereas photographic films rarely, if ever, employ blue tinted supports. Medical diagnostic film supports, including the incorporated blue dyes that contribute to cold image tones, are described in *Research Disclosure,* Vol. 184, Item 18431, August 1979, Item 18431, Section XII. Film Supports. *Research Disclosure,* Vol. 365, September 1994, Item 36544, Section XV. Supports, illustrates in paragraph (2) suitable surface modifying layer units, particularly the subbing layer components, to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly (ethylene) are specifically preferred polyester film supports.

In the simplest contemplated form of the invention the processing solution permeable front layer unit FLU consists of a single silver halide emulsion layer. To facilitate rapid access processing it is contemplated to limit coating coverages of silver halide grains contained in the emulsion layer to less than 30 mg/dm$^2$ silver, thereby allowing hydrophilic colloid necessary to protect the grains from wet pressure sensitivity to be coated at less than 30 mg/dm$^2$.

Further, the emulsion layer is selected so that it absorbs no more than 60 percent, preferably no more than 50 percent, of radiation employed for imagewise exposure. Limiting absorption of exposing radiation by the front layer unit is essential to permit efficient utilization of the back layer unit.

The processing solution permeable back layer unit (BLU) shares with the processing solution permeable front layer unit FLU responsibility for providing a viewable image.

From 40 to 60 percent and, ideally, 50 percent of overall image density and hence corresponding percentages of the total radiation-sensitive silver halide present in the film is provided by BLU. The most efficient arrangement in terms of maximizing the rate at which the film can be processed is for the same amounts of silver to be coated in FLU and BLU.

FLU and BLU can employ the same silver halide emulsions currently employed in single-sided mammographic films. The emulsions forming FLU and BLU are selected so that the film exhibits an average contrast in the range of from 2.5 to 3.5, measured over a density range above fog of from 0.25 to 2.0.

In a specific, preferred form of the invention the emulsions are tabular grain emulsions. The following, here incorporated by reference, are illustrative of high bromide {111} tabular grain emulsions specifically contemplated to be incorporated in FLU and BLU:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitouet al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain at least 70 mole percent bromide and optimally at least 90 mole percent bromide, based on silver. Silver bromide, silver iodobromide, silver chlorobromide, silver iodo-chlorobromide, and silver chloroiodobromide tabular grain emulsions are specifically contemplated. Although silver chloride and silver bromide form tabular grains in all proportions, chloride is preferably present in concentrations of 30 (optimally 10) mole percent or less, based on silver. Iodide is preferably limited to less than 4 (most preferably less than 1) mole percent, based on silver.

In the tabular grain emulsions, tabular grains account for greater than 50 (preferably greater than 70 and optimally greater than 90) percent of total grain projected area. Emulsions in which tabular grains account for substantially all (>97%) of total grain projected area are taught in the patents cited above.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference. Dopants for increasing imaging speed by providing shallow electron trapping sites (i.e. SET dopants) are the specific subject matter of *Research Disclosure*, Vol. 367, Nov. 1994, Item 36736.

It is specifically contemplated to reduce high intensity reciprocity failure (HIRF) by the incorporation of iridium as a dopant. To be effective for reciprocity improvement the Ir must be incorporated within the grain structure. To insure total incorporation it is preferred that Ir dopant introduction be complete by the time 99 percent of the total silver has been precipitated. For reciprocity improvement the Ir dopant can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations. The reason for this is that these dopants form deep electron traps and are capable of decreasing grain sensitivity if employed in relatively high concentrations. These non-SET Ir dopants are preferably incorporated in concentrations of at least $1\times10^{-9}$ mole per silver up to $1\times10^{-6}$ mole per silver mole. However, when the Ir dopant is in the form of a hexacoordination complex capable of additionally acting as a SET dopant, concentrations of up to about $5\times10^{-4}$ mole per silver, are contemplated. Specific illustrations of useful Ir dopants contemplated for reciprocity failure reduction are provided by B. H. Carroll, "Iridium Sensitization: A Literature Review", *Photographic Science and Engineering*, Vol. 24, No. 6 November/December 1980, pp. 265–267; Iwaosa et al U.S. Pat. No. 3,901,711; Grzeskowiak et al U.S. Pat. No. 4,828,962; Kim U.S. Pat. No. 4,997,751; Maekawa et al U.S. Pat. No. 5,134,060; Kawai et al U.S. Pat. No. 5,164,292; and Asami U.S. Pat. Nos. 5,166,044 and 5,204,234.

The contrast of the emulsions can be increased by doping the grains with a hexacoordination complex containing a nitrosyl (NO) or thionitrosyl (NS) ligand. Preferred coordination complexes of this type are disclosed by McDugle et al U.S. Pat. No. 4,933,272, the disclosure of which is here incorporated by reference.

The contrast increasing dopants (hereinafter also referred to as NO or NS dopants) can be incorporated in the grain structure at any convenient location. However, if the NO or NS dopant is present at the surface of the grain, it can reduce the sensitivity of the grains. It is therefore preferred that the NO or NS dopants be located in the grain so that they are separated from the grain surface by at least 1 percent (most preferably at least 3 percent) of the total silver precipitated in forming the silver iodochloride grains. Preferred contrast enhancing concentrations of the NO or NS dopants range from $1\times10^{-11}$ to $4\times10^{-8}$ mole per silver mole, with specifically preferred concentrations being in the range from $10^{-10}$ to $10^{-8}$ mole per silver mole.

Combinations of Ir dopants and NO or NS dopants are specifically contemplated. Where the Ir dopant is not itself a SET dopant, it is specifically contemplated to employ non-SET Ir dopants in combination with SET dopants. Where a combination of SET, non-SET Ir and NO or NS dopants are employed, it is preferred to introduce the NO or NS dopant first during precipitation, followed by the SET dopant, followed by the non-SET Ir dopant.

Differing emulsions can be blended or coated in separate layers to fine tune emulsions for satisfy specific aim characteristics. For example, multiple coatings or blending can be conveniently undertaken to arrive at a specific speed or contrast. Both the blending of emulsions and the coating of emulsions in separate superimposed layers are well known, as illustrated by *Research Disclosure,* Item 36544, I. Emulsion grains and their preparation, E. Blends, layers and performance categories, paragraphs (1), (2), (6) and (7).

After precipitation and before chemical sensitization the emulsions can be washed by any convenient conventional technique. Conventional washing techniques are disclosed by *Research Disclosure,* Item 36544, cited above, Section III. Emulsion washing.

The emulsions can be chemically sensitized by any convenient conventional technique. Such techniques are illustrated by *Research Disclosure,* Item 36544, IV. Chemical sensitization. Sulfur and gold sensitizations are specifically contemplated.

The emulsions are spectrally sensitized to provide an absorption half-peak bandwidth that overlaps the peak emission of the intensifying screen used for their exposure. Specific illustrations of conventional spectral sensitizing dyes are provided by *Research Disclosure,* Item 18431, Section X. Spectral Sensitization, and Item 36544, Section V. Spectral sensitization and desensitization, A. Sensitizing dyes.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 36544, Section VII. Antifoggants and stabilizers, and Item 18431, Section II. Emulsion Stabilizers, Antifoggants and Antikinking Agents.

The FLU need not be limited to a single layer. As noted above, the coating of separate silver halide grain populations in successive layers rather than blending is well known in the art. In addition, it is common practice to provide a surface overcoat (SOC) layer and, in many instances, the combination of an SOC layer and an interlayer (IL). These layers can be accommodated in the front layer unit so long as the overall coating coverage of the front layer unit of 30 mg/dm$^2$ of hydrophilic colloid is not exceeded. The contemplated sequence of layers is as follows:

| |
|---|
| Surface Overcoat (SOC) |
| Interlayer (IL) |
| Emulsion Layer (EL) |
| (ELU-1) |

where the emulsion layer EL is coated nearest the support.

The surface overcoat SOC is typically provided for physical protection of the emulsion layer. The surface overcoat contains a conventional hydrophilic colloid as a vehicle and can contain various addenda to modify the physical properties of the overcoats. Such addenda are illustrated by *Research Disclosure,* Item 36544, IX. Coating physical property modifying addenda, A. Coating aids, B. Plasticizers and lubricants, C. Antistats, and D. Matting agents. The interlayer IL, when present, is a thin hydrophilic colloid layer that provide a separation between the emulsion and the surface overcoat addenda. It is a quite common alternative to locate surface overcoat addenda, particularly matte particles, in the interlayer. The use of silver halide grains as matte particles to reduce gloss as taught by Childers et al U.S. Pat. No. 5,041,364 and as illustrated in the Examples below, is specifically contemplated.

The silver halide emulsion and other layers forming the processing solution permeable front layer unit contain conventional hydrophilic colloid vehicles (peptizers and binders), typically gelatin or a gelatin derivative. Conventional vehicles and related layer features are disclosed in *Research Disclosure,* Item 36544, II. Vehicles, vehicle extenders, vehicle-like addenda and vehicle related addenda. The emulsions themselves can contain peptizers of the type set out in II. above, paragraph A. Gelatin and hydrophilic colloid peptizers. The hydrophilic colloid peptizers are also useful as binders and hence are commonly present in much higher concentrations than required to perform the peptizing function alone. The vehicle extends also to materials that are not themselves useful as peptizers. Such materials are described in II. above, C. Other vehicle components.

The elements of the invention are preferably fully forehardened to facilitate accelerated rapid access processing. To increase covering power and hence allow reduction of both the levels of silver and hydrophilic colloid required, it is possible to partially foreharden and supplement hardening with a prehardener, such as glutaraldehyde, incorporated in the developer solution contained in the rapid access processor. Conventional forehardeners in II. above, B. Hardeners.

BLU, except as specifically noted, can be identical to FLU. BLU differs in its required function from FLU in that there is no requirement that it transmit any portion of the exposing radiation that it receives. It is, in fact, necessary that BLU absorb a larger percentage of the exposing radiation it receives than FLU, otherwise an image of unacceptably degraded sharpness results. BLU exhibits an optical density to exposing radiation of at least 0.50 (corresponding to about 70 percent absorption). Preferably the optical density of BLU is at least 1.0. Since the exposing radiation received by BLU that is not absorbed by it serves no useful purpose and sharpness is increased as the percentage of exposing radiation absorbed by BLU is increased, there is no theoretical maximum optical density. There is, as a practical matter, no significant further improvement in sharpness to be realized by increasing optical density above 3.0 and, for the majority of applications, the optical density of BLU is ideally in the range of from 1.0 to 2.0.

Although coating a higher percent of total silver in BLU than in FLU can contribute to increasing the optical density of BLU, the balance of silver required for rapid access processing precludes satisfying the optical density of BLU by simply increasing the silver in BLU.

In the wavelength ranges at which exposure of the film of the invention would ordinarily be exposed absorption of exposing radiation is almost, if not entirely, attributable to the spectral sensitizing dye adsorbed to the surface of the latent image forming silver halide grains. Increasing the proportion of this dye in relation to silver above its optimum levels for spectral sensitization to increase optical density is precluded, since this results in desensitization of the silver halide emulsion.

What then is required in BLU to increase its optical density to the levels indicated above is a dye capable of absorbing radiation of the wavelengths employed for image-wise exposure that also exhibits little or no desensitization of the silver halide emulsion. In addition the dye must exhibit an optical density of less than 0.1 in the visible spectrum at the conclusion of film processing.

Fortunately, a variety of dyes satisfying these criteria are known in the art. When imagewise exposure occurs within the visible spectrum, such as occurs when a conventional green or red emitting intensifying screen is employed, the optical density of the dye must be reduced prior to the completion of processing. Dyes having these characteristics are disclosed in *Research Disclosure,* Item 36544, cited above, VIII. Absorbing and scattering materials, Section B. Absorbing materials, here incorporated by reference. Typically the dyes that absorb in the visible spectrum are processing solution decolorized. Usually one or more of the processing solutions alters the chromophore of the dye to eliminate optical density that is unwanted in the processed film. To eliminate or at least minimize emulsion desensitization the dyes are preferably coated as particulate dispersions, as disclosed particularly in Section B, paragraph (4).

In a form that simplifies manufacture the film can be coated so that BLU is identical to FLU, except that it additionally contains in an overcoat, e.g., SOC or IL, a dye as described above to increase optical density during image-wise exposure. If the dye is coated as an extra layer, some additional hydrophilic colloid is necessary to accomplish this and the hydrophilic colloid of BLU can exceed that of FLU, but it is contemplated that the hydrophilic colloid coverage of BLU will remain in all instances less than 40 $mg/dm^2$. Preferably the hydrophilic colloid coverage of BLU remains within the coating coverage ranges describe above for FLU.

It is additionally recognized that the dye incorporated to increase optical density can be placed directly within the emulsion layer or layers forming BLU, although this is not preferred, since the dye is then intercepting some of the exposing radiation that would otherwise be absorbed by the silver halide grains. On the other hand, if the optical density increasing dye is incorporated in the silver halide emulsion, this eliminates any necessity of adding hydrophilic colloid to BLU for the sole purpose of coating a dye containing layer. A specifically contemplated compromise is to the split the emulsion contained in BLU into two layers, with the optical density increasing layer being confined to the dye farthest from the support. The one location of the optical density increasing dye that leads to unacceptable performance and is specifically excluded from the practice of the invention is placement of the dye in a layer interposed between the transparent film support and the emulsion layer or layers forming BLU.

Although BLU as described above can be identical to FLU, except for inclusion of the optical density increasing dye, in practice it is recognized that that these layer units can be independently varied in construction within the general ranges described above. While identical front and back emulsion coatings maximize manufacturing convenience, there are number of factors to indicate that optimization of performance dictates different selections of FLU and BLU components. Most notably, unlike a conventional dual-coated medical diagnostic film exposed by front and back intensifying screens, BLU receives only the fraction of exposing radiation that has not been absorbed by FLU. Thus, if identical emulsions are employed in FLU and BLU, the latter must necessarily make a smaller contribution to the overall image density. This can be offset by increasing the silver coverage of BLU above that of FLU. If the sensitivity of the silver halide grains in BLU is increased in relation to those of FLU, overall contrast is increased. If the sensitivity of the silver halide in FLU is increased in relation to that of BLU, exposure latitude can be increased. For soft tissue imaging applications structures are generally preferred that increase contrast.

In addition to the specific features of the elements of the invention described above, it is, of course, recognized that the elements of the invention can be modified to contain any one or combination of compatible conventional features not essential to the practice of the invention. Such features can be selected from those disclosed in *Research Disclosure,* Items 18431 and 36544, cited above.

It is contemplated to image-wise expose the dual-coated radiographic film of the invention with a single intensifying screen of the type currently employed for mammographic imaging of single-sided elements. Intensifying screens having the characteristics of the back screens disclosed by Luckey et al U.S. Pat. No. 4,710,637, cited above and here incorporated by reference, are specifically contemplated. Although suitable intensifying screens have a relatively high MTF, MTF need not be nearly as high as that of the front screen required by Luckey et al, which sets a very high MTF for its front screen to compensate for an overall loss of sharpness attributable to the use of two intensifying screens. It has been discovered quite unexpectedly that a dual-coated radiographic element can produce images of satisfactory sharpness and mottle when exposed with a single intensifying screen of a type currently employed for soft tissue imaging of radiographic elements having a single emulsion layer unit. The construction of BLU makes it possible for the first time to expose a dual-coated radiographic element with a single intensifying screen while still obtaining a sharp and low mottle image.

The X-radiation employed for exposure is preferably predominantly of an energy level less than 40 keV. Although the intensifying screen can be placed to receive X-radiation that has passed through the film, the intensifying screen is preferably placed between the dual-coated film and the source of X-radiation. This placement, plus the low energy of the X-radiation allows the screen to absorb a high percentage of the X-radiation. If desired, a collimating grid can be used with the intensifying screen and dual-coated film. Illustrative collimating grids are illustrated by Freeman U.S. Pat. No. 2,133,385, Stevens U.S. Pat. No. 3,919,559, Albert U.S. Pat. No. 4,288,697, Moore et al U.S. Pat. No. 4,951,305 and Steklenski et al U.S. Pat. No. 5,259,016.

An important advantage of dual-coated radiographic elements for soft tissue imaging is that they are much better suited for rapid access processing than radiographic elements containing a single emulsion layer unit. The dual-coated films of this invention are, in fact, better suited for rapid access processing than most conventional low crossover dual-coated films, since the dual-coated films of this invention do not incorporate a crossover reduction layer interposed between the support and each emulsion layer unit. This allows the amount of hydrophilic colloid coated on each side of the support to be decreased further than is possible with a conventional dual-coated "zero crossover" film.

Rapid access processing following imagewise exposure can be undertaken in the same manner as that of conventional dual-coated medical diagnostic imaging elements. The rapid access processing of such elements is disclosed, for example, in Dickerson et al U.S. Pat. Nos. 4,803,150, 4,900,652, 4,994,355, 4,997,750, 5,108,881, 5,252,442, and 5,399,470, the disclosures of which are here incorporated by reference. A more general teaching of rapid access processing is provided by Barnes et al U.S. Pat. No. 3,545,971, the disclosure of which is here incorporated by reference. More specifically, the rapid access processing cycle and typical developer and fixer described above in connection with Kodak X-OMAT 480 RA™ is specifically contemplated for use in the practice of this invention.

EXAMPLES

The invention can be better appreciated by reference to the following specific embodiments. Coating coverages placed in parenthesis are in units of mg/dm$^2$, except as otherwise stated. Silver halide coating coverages are reported in terms of the weight of silver.

Performance comparisons of the following radiographic elements were undertaken to demonstrate the advantages of the invention. As shown, the front layer unit is positioned above the support and the back layer unit is positioned below the support.

| Film A (an example of the invention) |
|---|
| SOC [F] |
| Interlayer [F] |
| Emulsion layer [F] |
| Support |
| Emulsion layer [B] |
| Density providing layer (DPL) |
| Interlayer [B] |
| SOC [B] |

| Film B (a control dual-coated film without DPL) |
|---|
| SOC [F] |
| Interlayer [F] |
| Emulsion layer [F] |
| Support |
| Emulsion layer [B] |
| Interlayer [B] |
| SOC [B] |

| Film C (a control dual-coated film with crossover control) |
|---|
| SOC [F] |
| Interlayer [F] |
| Emulsion layer [F] |
| Crossover Control [F] |
| Support |
| Crossover Control [B] |
| Emulsion layer [B] |
| Interlayer [B] |
| SOC [B] |

| Film D (a control single-sided emulsion film) |
|---|
| SOC [F] |
| Interlayer [F] |
| Emulsion layer [F] |
| Support |
| Pelloid [B] |
| Interlayer [B] |
| SOC [B] |

Film A

The following is a detailed description of the components of the film:

| | |
|---|---|
| SOC [F] | |
| Gelatin | (3.4) |
| Methyl methacrylate matte beads | (0.14) |
| Carboxymethyl casein | (0.57) |
| Colloidal silica (Ludox AM ™) | (0.57) |
| Polyacrylamide | (0.57) |
| Chrome alum | (0.025) |
| Resorcinol | (0.058) |
| Whale oil lubricant (Spermafol ™) | (0.15) |
| Interlayer [F] | |
| Gelatin | (3.4) |
| AgI Lippmann emulsion (0.08 μm) | (0.11) |
| Carboxymethyl casein | (0.57) |
| Ludox AM ™ | (0.57) |
| Polyacrylamide | (0.57) |
| Chrome alum | (0.025) |
| Resorcinol | (0.058) |
| Nitron | (0.044) |
| Emulsion Layer [F] | |
| AgBr tabular grains | (20.7) |
| Gelatin | (23.9) |
| TAI (2.1 g/Ag mole) | |
| Potassium nitrate | (1.8) |
| Ammonium hexachloropalladate | (0.0022) |
| Maleic acid hydrazide | (0.0087) |
| Sorbitol | (0.53) |
| Glycerin | (0.57) |
| Potassium Bromide | (0.14) |
| Resorcinol | (0.44) |
| BVSME (2.4% by wt, based on total gelatin) | |

The tabular grains had a mean thickness of 0.13 μm and a mean equivalent circular diameter of 1.8 μm. The TAI was 4-hydroxy-6-methyl-1,3,3A,7-tetraazaindene. The BVSME was bis(vinylsulfonylmethyl)ether.

Support

The support was a 7 mil (170 μm) blue tinted polyester radiographic film support with conventional subbing layer units coated on its opposite major faces. Each subbing layer unit contained a layer of poly(acrylonitrile-co-vinylidene chloride) overcoated with a layer of layer of gelatin (1.1).

Emulsion Layer [B]

This layer was identical to Emulsion Layer [F], except that the gelatin was reduced to (18.4).

Density Providing Layer

| | |
|---|---|
| Magenta dye | (2.2) |
| Gelatin | (5.4) |

The magenta dye was a processing solution decolorizable dye in the form of a solid particle dispersion, as described in Dickerson U.S. Pat. No. 4,994,355.

Interlayer [B]

This interlayer was identical to Interlayer [F].

SOC [B]

This surface overcoat was identical to SOC [F].

Film B

Film B was constructed like Film A, except the density providing layer was omitted and the gelatin levels in both emulsion layers are the same as that of the front emulsion layer of Film A.

Film C

Film C was similar to Film B, except that in each of the crossover control layers magenta solid particle dye (2.17) of the type employed in the DPL layer of Film A was present in gelatin (5.64.

Film D

Film D was constructed like Film A, except that all of the emulsion, silver (41.2) and gelatin (47.7), was coated on one side and a pelloid was coated on the opposite emulsion side. The pelloid layer also contained gelatin (47.7) and mixture of the following processing solution decolorizable dyes:

(D-1) Bis[3-methyl-1-p-sulfophenyl)-2-pyrazollin-5-one-(4)]methineoxonol (2.4);

(D-2) Bis(1-butyl-3-carboxymethyl-5-barbituric acid) trimethineoxonol (1.1);

(D-3) 4-[4-(3-Ethyl-2(3H)-benzoxazolylidene-2-butenylidene]-3-methyl-1-p-sulfophenyl-2-pyrazolin-5-one, monosulfonated (0.8); and (D-4) Bis[3-methyl-1-(p-sulfophenyl)-2-pyrazolin-5-one-(4)]pentamethineoxonol.

Intensifying Screen

The intensifying screen employed was of a type in current commercial use as a high resolution screen designed for mammographic imaging. It consisted of a terbium activated gadolinium oxysulfide phosphor having a median particle size of 5 μm coated on a blue tinted transparent poly (ethylene terephthalate) (Estar™) support in a polyurethane (Permuthane™) binder at a total phosphor coverage of (3.4) and at weight ratio of phosphor to binder of 21:1. The binder additionally contained 0.0015% carbon, based on total weight of the coating.

Exposure and Processing

Samples of the films were exposed by the Intensifying Screen to provide evaluations of image sharpness. The screen was mounted between the front side of each film sample and the source of X-radiation. The screen-film assemblies were exposed to 26 kVp X-radiation using a GE Senographe DMR™ mammographic X-ray unit with a 66 cm film focal distance and a large focal spot size. This unit employs a molybdenum target and filtration.

Film speed and contrast were measured from samples of the film that received a simulated screen exposure. Samples of the films were exposed through a graduated density step tablet to a MacBeth™ sensitometer for 0.5 second to a 500 watt General Electric DMX projector lamp calibrated to 2650° K filtered with a Corning C4010 filter to simulate a green emitting intensifying screen emission.

Processing was conducted using a Kodak X-OMAT M6A-N™ processor, using the processing cycle, developer and fixer, previously described.

Drying Characteristics

To compare rates of drying (and hence to assess the maximum rate which a film can be passed through the drying section of a rapid access processor), as a film just exists from the rapid accessor processor, the processor was stopped and the film was removed. Roller marks on the film were noted, indicative of incomplete drying. Marks over all of the film indicate incomplete drying. Marks over less than all of the film indicate that the film has dried at some intermediate location within the drier section of the rapid access processor. Drying rates are reported in terms of the percentage of the drying section required to completely dry the film (% Drying).

Sensitometry

Sharpness was determined by visually comparing images in the film samples. On a scale of from 1 to 10, the film exhibiting the sharpest images was given a 1 rating and the film exhibiting the least sharp image was given a rating of 10, with other films given intermediate ratings based on comparisons with the films representing the image sharpness extremes.

Film speed was measured at a density of 1.0 above minimum density. Speed is reported in relative log units—that is, each 100 units of difference in speed is equal to 1.00 log E, where E is exposure in lux-seconds.

Film contrast was measured as the average contrast between a density of 0.25 above minimum density and a density of 2.5 above minimum density.

Performance Comparisons

The performance of the films is summarized in Table I.

TABLE I

| Film | Speed | Contrast | Sharpness | Drying |
|---|---|---|---|---|
| A (example) | 434 | 3.0 | 1 | 50 |
| B (control) | 438 | 3.2 | 3 | 50 |
| C (control) | 424 | 1.3 | 10 | 70 |
| D (control) | 432 | 3.0 | 1 | >100 |

Films A, B and D exhibited speeds that were essentially similar. Film C, the conventional dual-coated film with crossover control layers exhibited a significantly lower speed. Film C also gave unacceptable performance in both contrast and sharpness. From this it is apparent that the low crossover (sometimes referred to as zero crossover) films used with intensifying screen pairs to obtain images of high levels of sharpness are, in fact, entirely unsuited for use with a single intensifying screen.

Films A, B and C provided similar contrast in a range useful for mammographic imaging. Only Films A and D provided the highest observed levels of image sharpness. However, Film D was unacceptable in that it emerged from the rapid access processor still wet. By coating the emulsion entirely on one side of the support, as is currently done in commercial mammographic films, a film having clearly inferior drying properties resulted.

Films A and B showed superior processing characteristics, each requiring only 50 percent of dryer capacity for drying. Film C required a slightly higher amount of dryer capacity, but produced unacceptably unsharp images.

Film A exhibited image sharpness characteristics clearly superior to those of Film B.

Thus, when all performance characteristics were taken into account, it was apparent that overall superior performance was exhibited by Film A, satisfying invention requirements, while the remaining films showed unacceptable or inferior performance in at least one tested characteristic.

The invention has been described in detail with particular reference to preferred embodiments thereof, but it will be understood that variations and modifications can be effected within the spirit and scope of the invention.

What is claimed is:

1. A radiographic film for recording medical diagnostic images of soft tissue through (a) exposure to light emitted by a single intensifying screen located to receive an image bearing source of X-radiation and (b) processing, including development, fixing and drying, in 90 seconds or less comprised of a film support transparent to radiation emitted by the intensifying screen and having front and back major faces and an image-forming portion for providing, when imagewise exposed by the intensifying screen and processed, an average contrast in the range of from 2.5 to 3.5, measured over a density above fog of from 0.25 to 2.5, wherein the image-forming portion is comprised of a processing solution permeable front layer unit coated on the front major face of the support capable of absorbing up to 60 percent of the emitted light and containing (a) hydrophilic colloid, the hydrophilic colloid being limited to less than 30 mg/dm$^2$, and (b) radiation-sensitive silver halide grains, the silver halide grains being limited to less than 30 mg/dm$^2$ silver and a processing solution permeable back layer unit coated on the back major face of the support containing (a) hydrophilic colloid, the hydrophilic colloid being limited to less than 40 mg/dm$^2$, (b) silver in the form of radiation-sensitive silver halide grains accounting for from 40 to 60 percent of the total radiation-sensitive silver halide grains present in the film, and (c) a dye capable of imparting to the film at the time of light exposure an optical density of at least 0.40 in the wavelength region of the emitted light to be recorded and, after processing, an optical density of less than 0.1 in the visible spectrum, the back layer unit being comprised of layers, with a first layer containing the radiation-sensitive silver halide grains and the dye being excluded from the first layer and being present in at least one remaining layer coated farther from the support than the first layer.

2. A radiographic film for recording medical diagnostic images of soft tissue according to claim 1 wherein the hydrophilic colloid in each of the front and back layer units is limited in amount to less than 30 mg/dm$^2$ of hydrophilic colloid.

3. A radiographic film for recording medical diagnostic images of soft tissue according to claim 1 wherein the radiation-sensitive silver halide grains in each of the front and back layer units are limited in amount to less than 20 mg/dm$^2$ of silver.

4. A radiographic film for recording medical diagnostic images of soft tissue according to claim 1 wherein the dye imparts to the film at the time of exposure an optical density of up to 3.00 in the wavelength region of the emitted light.

5. A radiographic film for recording medical diagnostic images of soft tissue according to claim 4 wherein the dye imparts to the film at the time of exposure an optical density of at least 1.00 in the wavelength region of the emitted light.

6. A radiographic film for recording medical diagnostic images of soft tissue according to claim 1 wherein the dye exhibits a half peak aborption bandwidth over the spectral region of peak emission by the intensifying screen.

7. A radiographic film for recording medical diagnostic images of soft tissue according to claim 1 wherein the radiation-sensitive silver halide grains in the front and back layer units are provided by a tabular grain silver halide emulsion containing greater than 70 mole percent bromide and less than 4 mole percent iodide, based on total silver.

8. A radiographic film for recording medical diagnostic images of soft tissue according to claim 7 wherein the radiation-sensitive silver halide grains contain less than 1 mole percent iodide, based on total silver.

9. A radiographic film for recording medical diagnostic images of soft tissue according to claim 7 wherein tabular grains account for greater than 70 percent of total projected area of the silver halide grains.

10. A process of obtaining a medical diagnostic image of soft tissue comprising (a) mounting a radiographic film according to any one of claims 2 and 9 inclusive adjacent a single intensifying screen, (b) exposing the intensifying screen to an image pattern of X-radiation that has passed through the soft tissue to stimulate light emission by the intensifying screen that imagewise exposes the radiographic film, and (c) processing the radiographic film, including development, fixing and drying in less than 90 seconds.

* * * * *